US009523470B2

(12) United States Patent
Lai

(10) Patent No.: US 9,523,470 B2
(45) Date of Patent: Dec. 20, 2016

(54) SIMULATED FLAME STRUCTURE

(71) Applicant: Wen-Cheng Lai, Taoyuan County (TW)

(72) Inventor: Wen-Cheng Lai, Taoyuan County (TW)

( * ) Notice: Subject to any disclaimer, the term of this patent is extended or adjusted under 35 U.S.C. 154(b) by 271 days.

(21) Appl. No.: 14/251,657

(22) Filed: Apr. 14, 2014

(65) Prior Publication Data

US 2015/0292697 A1 Oct. 15, 2015

(51) Int. Cl.

| | |
|---|---|
| ***F21S 6/00*** | (2006.01) |
| ***F21S 10/04*** | (2006.01) |
| *F21W 111/10* | (2006.01) |
| *F21W 121/00* | (2006.01) |

(52) U.S. Cl.

CPC ..... *F21S 10/046* (2013.01); *F21S 6/001* (2013.01); *F21W 2111/10* (2013.01); *F21W 2121/00* (2013.01)

(58) Field of Classification Search

CPC ..... F21S 10/043; F21S 10/00; F21S 1/04; F21V 5/007

USPC ..... 362/359, 161

See application file for complete search history.

(56) References Cited

U.S. PATENT DOCUMENTS

2005/0196716 A1* 9/2005 Haab ..... F21S 6/001 431/126
2006/0034100 A1* 2/2006 Schnuckle ..... B44C 5/06 362/161
2011/0110073 A1* 5/2011 Schnuckle ..... F21S 10/04 362/96
2011/0127914 A1* 6/2011 Patton ..... F21S 10/04 315/76
2013/0050985 A1* 2/2013 Kwok ..... F21S 6/001 362/96
2014/0177212 A1* 6/2014 Li ..... F21S 6/001 362/190
2014/0362592 A1* 12/2014 Lee ..... F21S 10/046 362/386
2015/0204530 A1* 7/2015 Lee ..... F21V 23/0457 362/282
2015/0233538 A1* 8/2015 Sheng ..... F21S 10/046 362/190
2015/0338042 A1* 11/2015 Patton ..... F21V 33/0052 348/742

* cited by examiner

*Primary Examiner* — Renee Chavez
*Assistant Examiner* — Christopher E Dunay
(74) *Attorney, Agent, or Firm* — C. G. Mersereau; Nikolai & Mersereau, P.A.

(57) ABSTRACT

A simulated flame structure comprises a bracket, a simulated flame element, a first magnetic element and a light-emitting element. The bracket is formed with a position limiting hole. The simulated flame element is restricted in the position limiting hole through a position limiting portion. The first magnetic element is disposed on the simulated flame element. The light-emitting element is disposed on the bracket and outputs light toward the simulated flame element. By magnetic attractive actions between the first magnetic element and a metal element in the position limiting hole, the simulated flame element may be suspended in the position limiting hole and naturally swing relatively to the bracket, thereby achieving visual effects of optimized flame combustion.

11 Claims, 4 Drawing Sheets

SIMULATED FLAME STRUCTURE

BACKGROUND OF THE INVENTION

1. Field of the Invention

The invention relates to applications of electronic lighting, and more particularly to a simulated flame structure of simulating flame combustion.

2. Description of the Prior Art

In today's society, although conventional illumination tools, such as candles, oil lamps or the like, have been replaced by various electric lamps, the candles or the oil lamps still have conventional meanings and distinctive visual effects in some special occasions or special situations, and thus cannot be replaced by the illumination lamps used in the today's daily life. For example, upon worshiping deities or ancestors, incense and candles are often used, and the beating fire on the candle is used to anchor the reminiscence on the ancestor and the endless longing to the posterity. Alternatively, in some occasions where specific atmospheres need to be created, the fire beating effect of the burning candle is also advantageous to the generation of different visual enjoyments. However, the conventional lamps, such as candles, oil lamps or the like, are used for illumination by way of flame combustion, and have the predetermined security risks. When the candles or oil lamps are upset due to the wind blowing or the artificial inadvertent touch, the ambient flammable objects tend to be ignited to cause the fire accident. Thus, simulated lamps for simulating candle illumination effects have been developed.

The existing simulated flame lamp typically has a lamp body manufactured to have a shape similar to that of a candlestick, a flame-shaped lamp shade on a top of the lamp body, and a light-emitting body disposed in the lamp shade. A battery disposed in the lamp body powers the light-emitting body so that the light is radiated out through the flame-shaped lamp shade and the effect of the ignited candle is formed. However, this lamp shade of the simulated lamp has the fixed shape, and the stable light source is formed after lighting and significantly different from the dynamic visual effect of the flame combustion on the candle.

In view of the associated problems induced by the design defects of the conventional simulated flame lamp, the present inventor has paid attention to the research and development of the simulation of the beating flame, and thus developed this invention after many tries.

SUMMARY OF THE INVENTION

A main object of the invention is to provide a simulated flame structure, in which an element, which is distant from the flame outlook and has natural and smooth swing actions to generate the beating visual effect similar to the flame combustion, is used.

Another object of the invention is to provide a simulated flame structure to replace the appliance, such as the candle or oil lamp that needs the flame combustion, to decrease the disasters caused by careless use, to avoid the harmful gas generated by the combustion (or incomplete combustion), and thus to enhance the environment quality, To achieve the above-identified objects, the invention provides a simulated flame structure mainly comprising a bracket, a simulated flame element, a first magnetic element and a light-emitting element. The bracket is formed with a position limiting hole, and has a magnetic-conducting metal element disposed in the position limiting hole. The simulated flame element is disposed in the position limiting hole, can swing relatively to the bracket, and comprises a flame portion, a position limiting portion and a vertical swinging portion. The position limiting portion is disposed between the flame portion and the vertical swinging portion and restricts the simulated flame element in the position limiting hole. The flame portion has a substantial flame model. The flame portion and the vertical swinging portion are respectively located above and below the position limiting hole. The first magnetic element is disposed on a lateral side of the position limiting portion, and generates magnetic forces attracting the metal element, so that the simulated flame element may be suspended in the position limiting hole. The light-emitting element is disposed in the bracket, and outputs light toward the flame portion.

Preferably, the first magnetic element and the metal element are disposed on two opposite sides of the simulated flame element, respectively.

Preferably, the position limiting portion is corresponding concave slots or corresponding projecting flanges between the flame portion and the vertical swinging portion.

Preferably, the position limiting hole is further inwardly projectingly formed with at least two position limiting pillars, and a position limiting space is formed between end portions of the position limiting pillars to restrict a swingable range of the simulated flame element.

Preferably, the metal element extends inwardly from one side of the position limiting hole, and has an end portion extending into the position limiting space.

Preferably, the end portion of the metal element is substantially arc-shaped.

Preferably, the light-emitting element is disposed in the position limiting hole, and on the other side of the simulated flame element corresponding to the metal element.

Preferably, the bracket is disposed on a base through at least one frame.

Preferably, the base further has a driving element for directly or indirectly driving the vertical swinging portion to swing.

Preferably, the vertical swinging portion and the driving element have a second magnetic element and a third magnetic element, respectively, so that the driving element indirectly drives the vertical swinging portion to swing by magnetic forces.

Preferably, the driving element is driven to rotate through a driving motor, and the third magnetic element is located at a position distant from a rotation axis by a predetermined distance.

Preferably, facing surfaces of the second magnetic element and the third magnetic element have the same magnetic pole.

Preferably, the base may further be combined with a cover body, the cover body has an opening at a position corresponding to the simulated flame element, and the flame portion extends out of the cover body and is exposed outside through the opening.

Preferably, the first magnetic element, the second magnetic element and the third magnetic element are permanent magnets.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

Figure 1:
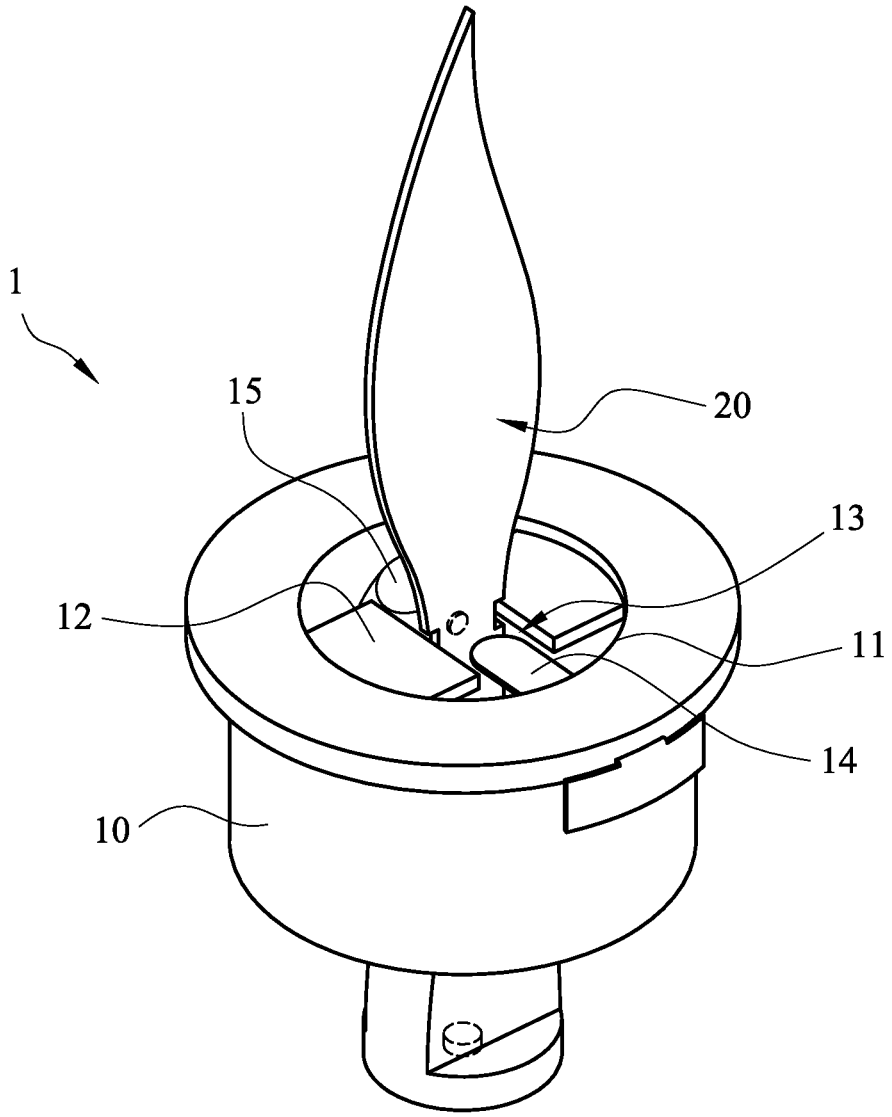
FIG. 1 is a pictorial view showing a main structure according to an embodiment of the invention.
Figure 2:
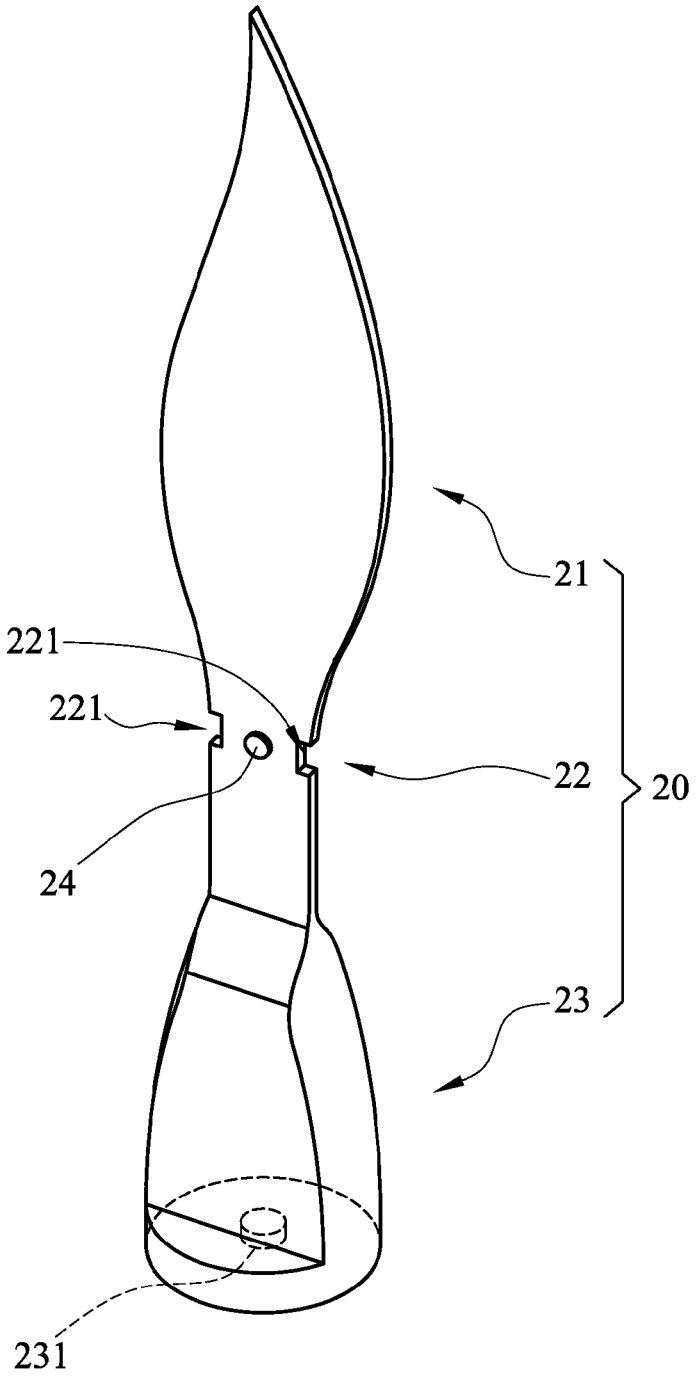
FIG. 2 is a pictorial view showing a simulated flame element according to the embodiment of the invention.

Referring to FIGS. 1 and 2, a main structure of a simulated flame structure 1 of this embodiment comprises a bracket 10 and a simulated flame element 20. The bracket 10 is formed with a circular position limiting hole 11. Two opposite sides of the position limiting hole 11 are inwardly projectingly formed with two position limiting pillars 12. A position limiting space 13 is formed between the end portions of the two position limiting pillars 12. The simulated flame element 20 includes a flame portion 21, a position limiting portion 22 and a vertical swinging portion 23. The position limiting portion 22 is disposed between the flame portion 21 and the vertical swinging portion 23. The simulated flame element 20 is restricted in the position limiting hole 11 through the position limiting portion 22, so that the simulated flame element 20 can swing relatively to the bracket 10 about the position limiting portion 22 serving as the center. In this embodiment, the position limiting hole 11 restricts the simulated flame element 20 using the position limiting pillars 12 on opposite two sides. So, a metal element 14 and a light-emitting element 15 are disposed on the other two sides of the position limiting space 13 corresponding to the two position limiting pillars 12 to properly prevent the simulated flame element 20 from sliding out of the range of the position limiting space 13 upon swinging. Similar to the position limiting pillar 12, the metal element 14 extends inwardly from one side of the position limiting hole 11, and extends into the position limiting space 13. The light-emitting element 15 is fixed at a suitable position of the position limiting hole 11 and outputs light toward the flame portion 21 of the simulated flame element 20. The light reflection is used to achieve the simulated flame effect. In addition, the metal element 14 is made of a magnetic-conducting metal material and has an arc-shaped end portion extending into the position limiting space 13. The simulated flame element 20 has a first magnetic element 24 at about the position of the position limiting portion 22 to produce a magnetic force attracting the metal element 14 so that the simulated flame element 20 can suspend in the position limiting hole 11. Thus, the simulated flame element 20 attracts the arc-shaped end portion of the metal element 14 through the first magnetic element 24, and the contact surface thereof is small so that the shaking and swinging amplitude and frequency can be generated more naturally without the generation of the sticking state. Using the natural wind blowing and shaking can form the swaying and swinging effects of the flame combustion changing with the air-flow, and the best simulated effect can be obtained.

In this embodiment, the position limiting portion 22 of the simulated flame element 20 is the corresponding concave slots 221 to form the sticking state with the position limiting pillars 12 of the position limiting hole 11 to restrict the simulated flame element 20 in the position limiting hole 11. Of course, the position limiting portion 22 may also be corresponding projecting flanges stuck on the position limiting pillars 12 by way of gravity, so that the simulated flame element 20 is freely movable in the position limiting space 13. In addition, the first magnetic element 24 is disposed on the other side of the simulated flame element 20 opposite to the metal element 14. The first magnetic element 24 and the metal element 14 are attracted via the simulated flame element 20, thereby effectively controlling the magnetic acting force to prevent the first magnetic element 24 from being completely attracted by the metal element 14, so that the simulated flame element 20 swings more smoothly, and the flame simulating effect is enhanced.

Figure 3:
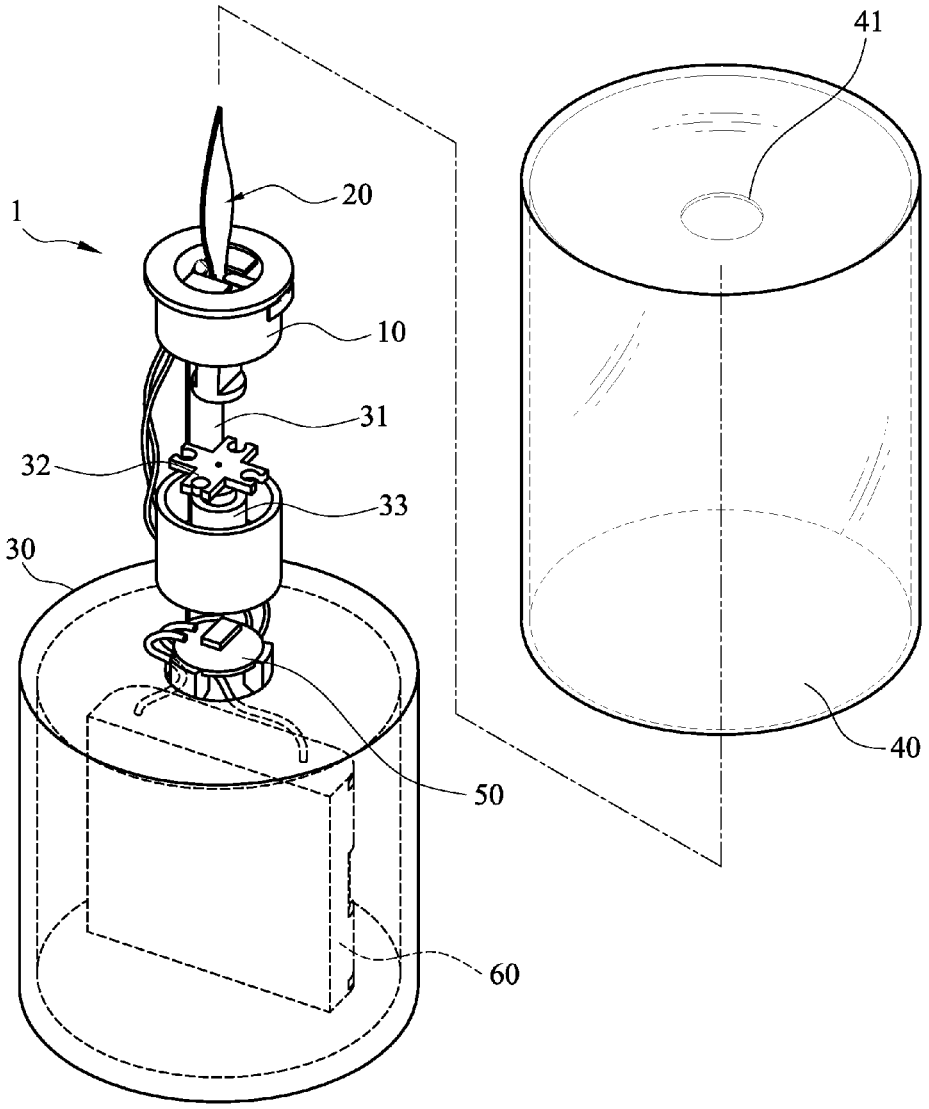
FIG. 3 is a schematic illustration showing a structure of the embodiment of the invention combined with a base and a cover body.
Figure 4:
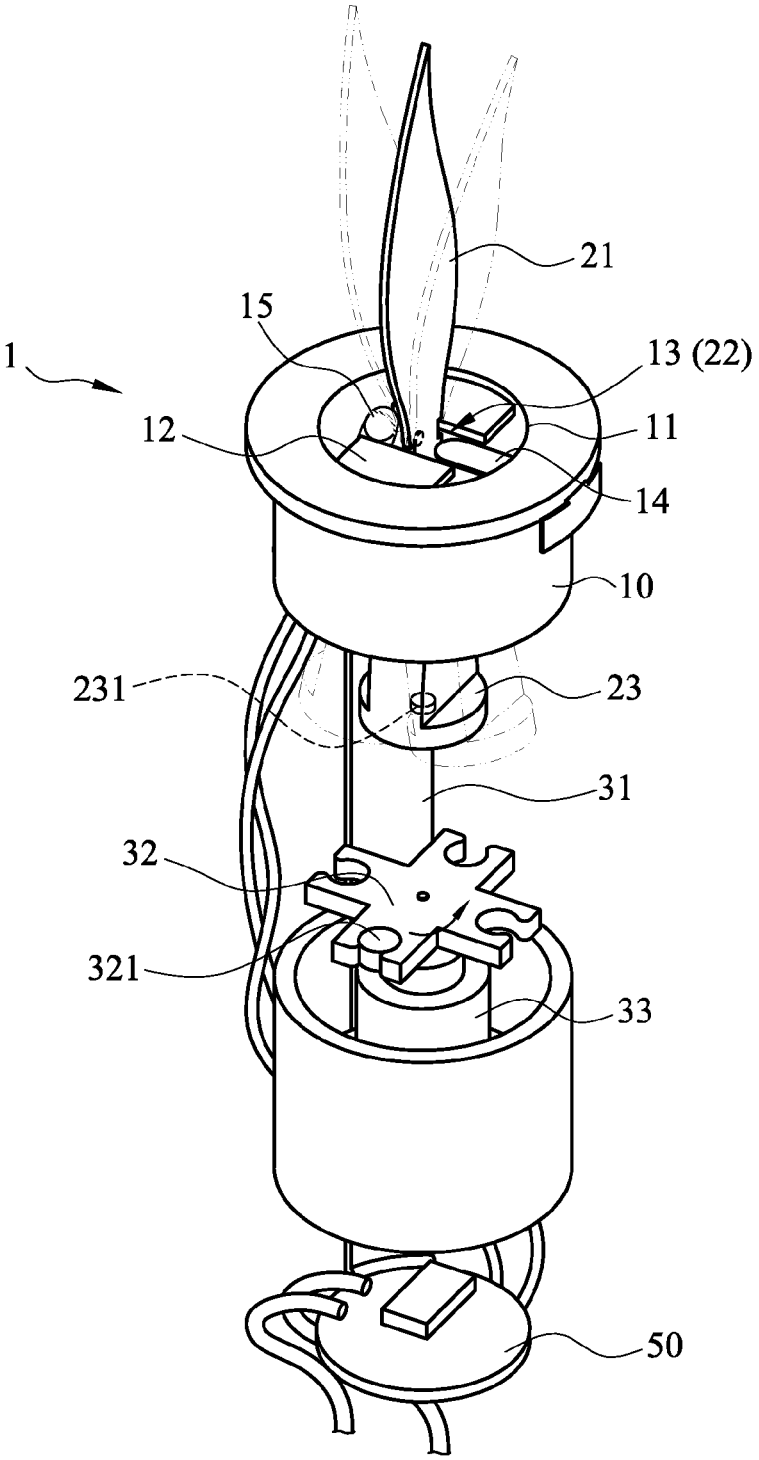
FIG. 4 is a schematic illustration showing that a driving element of the embodiment of the invention drives a vertical swinging portion to swing.

FIGS. 3 and 4 show aspects where the simulated flame structure 1 of this embodiment is applied to the lamp holder. The bracket 10 is connected to a frame 31 and is mounted on a base 30 through the frame 31. A driving mechanism, comprising a driving motor 33 and a driving element 32, is disposed on the base 30. The driving element 32 can be driven through the driving motor 33 and directly or indirectly drive the vertical swinging portion 23 to swing. In this embodiment, the driving element 32 and the driving motor 33 are disposed at the positions below the simulated flame structure 1, a second magnetic element 231 is disposed on the bottom of the vertical swinging portion 23, and a third magnetic element 321 is disposed on the driving element 32 and driven to rotate by the driving motor 33 through the driving element 32. The third magnetic element 321 is located at a position distant from the rotation axis by a predetermined distance, so that the third magnetic element 321 can also be rotated relatively to the rotation axis. By the magnetic attractive or repellent acting forces between the third magnetic element 321 and the second magnetic element 231, the driving element 32 can indirectly drive the vertical swinging portion 23 to swing. In this embodiment, the second magnetic element 231 and the third magnetic element 321 have the same pole to repel each other, so that the simulated flame element 20 naturally can swing and shake with the natural amplitude through the repellent acting forces.

Also, as shown in FIG. 3, an electronic substrate 50 and a power supply unit 60 may further be disposed on the base 30, on which a cover body 40 is disposed. The power supply unit 60, electrically connected to the electronic substrate 50, supplies the electric power. The electronic substrate 50 is additionally electrically connected to the light-emitting element 15 and the driving motor 33 to control the light-emitting element 15 and the driving motor 33 to operate. The cover body 40 is formed with an opening 41. When the cover body 40 is combined with the base 30, the flame portion 21 of the simulated flame element 20 extends out of the opening 41, so that the flame portion 21 is exposed outside the cover body 40, and the candle combustion effect can be formed in conjunction with the outlooks of the cover body 40 and the base 30. Also, the cover body 40 and the base 30 of this embodiment have a cylinder model similar to a candle, and the material thereof may be the real wax or the simulated wax to achieve the optimum visual effect. Of course, the outlooks of the cover body 40 and the base 30 may also be configured to have special models to be applied to various special environments according to the requirements, thereby preventing the danger from being caused by the fire, and enhancing the ambient environment quality.

In summary, the simulated flame structure of the invention indeed has the optimum effect of simulating the swinging flame, and can replace the flame, thereby enhancing the life quality and satisfying the novelty and the inventive step.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A simulated flame structure, comprising:

a bracket, which is formed with a position limiting hole, and has a metal element disposed in the position limiting hole, the metal element is a magnetic-conducting metal element, an end portion of the metal element is substantially arc-shaped;

a simulated flame element, which is disposed in the position limiting hole and swings relatively to the bracket, and comprises a flame portion, a position limiting portion and a vertical swinging portion, wherein the position limiting portion is disposed between the flame portion and the vertical swinging portion and restricts the simulated flame element in the position limiting hole, the position limiting portion includes two concave slots between the flame portion and the vertical swinging portion, two position limiting pillars extend inward from the position limiting hole and located corresponding to the two concave slots, a position limiting space is formed between end portions of the position limiting pillars to restrict a swingable range of the simulated flame element, the flame portion has a substantial flame model, and the flame portion and the vertical swinging portion are respectively located above and below the position limiting hole;

a first magnetic element, which is disposed on a lateral side of the position limiting portion, and generates magnetic forces attracting the metal element so that the simulated flame element is suspended beside the end portion of the metal element in the position limiting hole; and a light-emitting element, which is disposed in the bracket, and outputs light toward the flame portion, wherein positioning limiting portion of the simulated flame element is located between the metal element and the light-emitting element so as to prevent the simulated flame element from sliding out from the position limiting space.

2. The simulated flame structure according to claim 1, wherein the first magnetic element and the metal element are disposed on two opposite sides of the simulated flame element, respectively.

3. The simulated flame structure according to claim 1, wherein the metal element extends inwardly from one side of the position limiting hole, and has an end portion extending into the position limiting space.

4. The simulated flame structure according to claim 1, wherein the light-emitting element is disposed in the position limiting hole, and on the other side of the simulated flame element corresponding to the metal element.

5. The simulated flame structure according to claim 1, wherein the bracket is disposed on a base through at least one frame.

6. The simulated flame structure according to claim 5, wherein the base further has a driving element for directly or indirectly driving the vertical swinging portion to swing.

7. The simulated flame structure according to claim 6, wherein the vertical swinging portion and the driving element have a second magnetic element and a third magnetic element, respectively, so that the driving element indirectly drives the vertical swinging portion to swing by magnetic forces.

8. The simulated flame structure according to claim 7, wherein the driving element is driven to rotate through a driving motor, and the third magnetic element is located at a position distant from a rotation axis by a predetermined distance.

9. The simulated flame structure according to claim 8, wherein facing surfaces of the second magnetic element and the third magnetic element have the same magnetic pole.

10. The simulated flame structure according to claim 9, wherein the base may further be combined with a cover body, the cover body has an opening at a position corresponding to the simulated flame element, and the flame portion extends out of the cover body and is exposed outside through the opening.

11. The simulated flame structure according to claim 9, wherein the first magnetic element, the second magnetic element and the third magnetic element are permanent magnets.

* * * * *